United States Patent [19]

Parish et al.

[11] Patent Number: 5,027,937

[45] Date of Patent: Jul. 2, 1991

[54] LIQUID DIVERTING COIN CHUTE

[75] Inventors: Stanley G. Parish, Dallas; Clarence D. Zierhut, Richardson; Kelly K. Hand, Dallas, all of Tex.

[73] Assignee: Mid-South Enterprises, Dallas, Tex.

[21] Appl. No.: 495,280

[22] Filed: Mar. 16, 1990

[51] Int. Cl.[5] ..... G07F 1/04

[52] U.S. Cl. ..... 194/348

[58] Field of Search ..... 194/347, 348

[56] References Cited

U.S. PATENT DOCUMENTS

| | | | |
|---|---|---|---|
| 523,712 | 7/1894 | Rowlands | 194/339 X |
| 2,865,561 | 12/1958 | Rosapepe | 232/7 |
| 3,589,493 | 6/1971 | Hall . | |
| 4,062,435 | 12/1977 | Chalabian . | |
| 4,230,213 | 10/1980 | Spring . | |
| 4,306,644 | 12/1981 | Rockola et al. . | |
| 4,346,798 | 8/1982 | Agey, III . | |

FOREIGN PATENT DOCUMENTS

| | | | |
|---|---|---|---|
| 3101489 | 8/1982 | France | 194/347 |
| 0259485 | 10/1989 | Japan | 194/348 |
| 0311396 | 12/1989 | Japan | 194/348 |

*Primary Examiner*—Robert J. Spar
*Assistant Examiner*—William M. Hienz
*Attorney, Agent, or Firm*—Ross, Howison, Clapp & Korn

[57] ABSTRACT

A liquid diverting coin chute for conveying coins from a coin slot to a remotely positioned coin receptor includes a housing having sidewalls, front and rear walls, and top and bottom walls. The housing top wall includes an aperture for receiving coins from the coin slot. The housing bottom wall includes a first aperture for delivering coins to the coin receptor and a second aperture for dispensing liquid from the housing. A screen having front and back surfaces is disposed within the housing and extends from the housing top wall aperture to the housing bottom wall first aperture. The screen further extends between the housing sidewalls for conveying coins along the front surface thereof through the housing. The screen includes a plurality of apertures for passage of liquid therethrough to the bottom wall second aperture. The screen further includes a downwardly extending coin support surface perpendicularly disposed to the housing front and rear walls and extending between the housing sidewalls over which the edges of coins pass for directing coins to the bottom wall first aperture. The coin support surface includes a plurality of apertures for the passage of liquid therethrough to the bottom wall second aperture.

26 Claims, 3 Drawing Sheets

LIQUID DIVERTING COIN CHUTE

TECHNICAL FIELD OF THE INVENTION

This invention relates to coin hoppers for use on vending machines, and more particularly, to a liquid diverting coin chute for diverting liquid from a coin receptacle.

BACKGROUND OF THE INVENTION

In the operation of an automatic, coin-controlled vending machine, coins are normally inserted into a coin receptive slot and conveyed along a chute by gravity to a coin box. The coins are rejected or accepted and counted. The counting of coins is accomplished by passing the coins over switches or other circuit control devices located along the path of the falling coins. Actuation of the circuit control device or switch detects a credit and when sufficient credit is accumulated, the vending cycle may be initiated, to cause the delivery of a selected vending item to the customer.

Unscrupulous customers have developed ways to cheat or beat such vending machines by pouring or squirting liquid, such as salt water, into the coin chute via the coin receptive slot. When liquid is squirted into the coin slot of a typical vending machine, the liquid runs down the coin chute and sprays over the coin receiving, counting and credit mechanisms thereby shorting these related circuits and generally damaging the apparatus. On occasion, this shorting may cause a vending machine to "jackpot" or vend one or more times or even until all merchandise is dispensed. In other instances, the shorted circuits may cause money to be dispensed through the change or coin return mechanism thereby delivery all coins stored within the vending machine.

A need has thus arisen for a coin chute for a vending machine for diverting liquid which may enter the coin hopper through the coin slot of the vending machine from entering into the coin changer thereby preventing undesirable electrical conditions from occurring and preventing malfunction of the coin changer.

SUMMARY OF THE INVENTION

In accordance with the present invention, a liquid diverting coin chute for conveying coins from a coin slot to a remotely positioned coin receptor is provided. The coin chute includes a housing having sidewalls, front and rear walls, and top and bottom walls. The housing top wall includes an aperture for receiving coins from the coin slot. The housing bottom wall includes a first aperture for delivering coins to the coin receptor and a second aperture for dispensing liquid from the housing. A screen having front and back surfaces is disposed within the housing and extends from the housing top wall aperture to the housing bottom wall first aperture. The screen further extends between the housing sidewalls for conveying coins along the front surface thereof through the housing. The screen includes a plurality of apertures for passage of liquid therethrough to the bottom wall second aperture. The screen further includes a downwardly extending coin support surface perpendicularly disposed to the housing front and rear walls and extending between the housing sidewalls over which the edges of coins pass for directing coins to the bottom wall first aperture. The coin support surface includes a plurality of apertures for the passage of liquid therethrough to the bottom wall second aperture.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
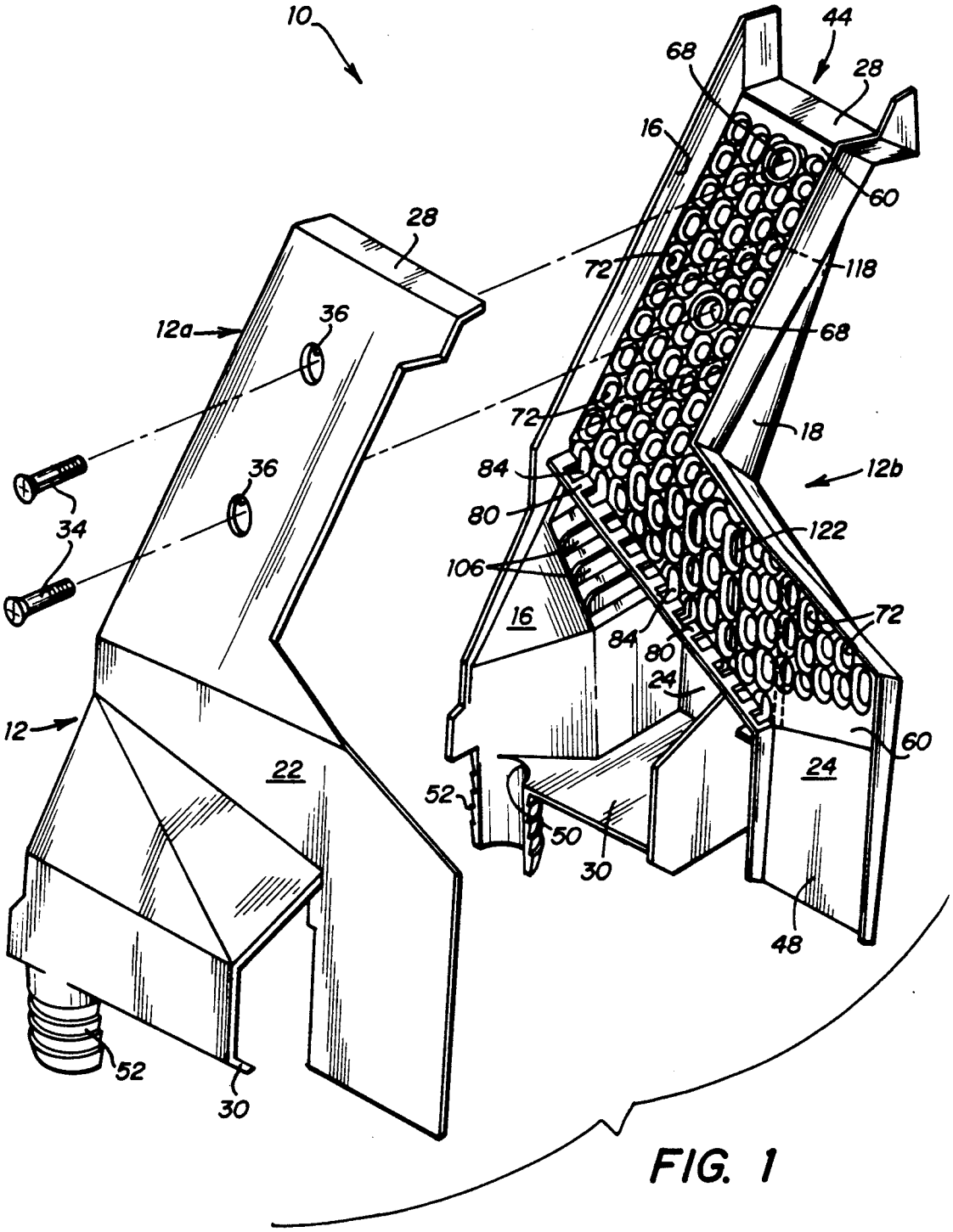
FIG. 1 is an exploded perspective view of the present liquid diverting coin chute.
Figure 2:
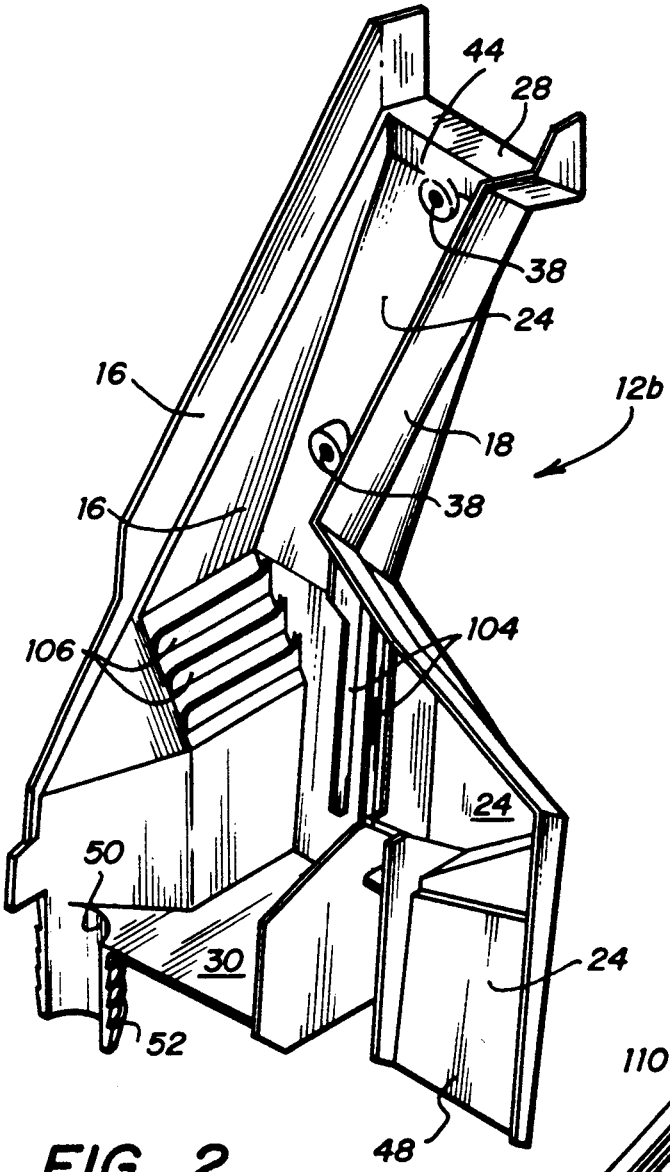
FIG. 2 is a perspective view of the rear housing portion of the present liquid diverting coin chute illustrated in FIG. 1.
Figure 3:
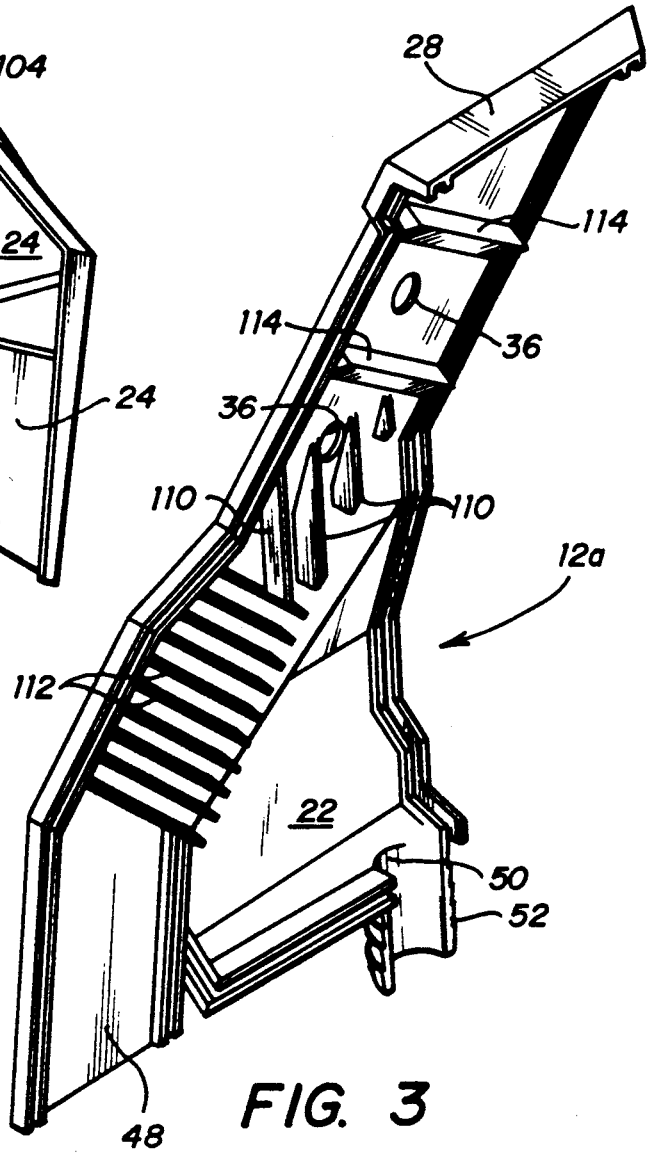
FIG. 3 is a perspective view of the front housing portion of the present liquid diverting coin chute illustrated in FIG. 1.

Referring simultaneously to FIGS. 1, 2, and 3, the present liquid diverting coin chute is illustrated, and is generally identified by the numeral 10. Liquid diverting coin chute 10 functions to convey coins from a coin slot of a vending machine (not shown) to a remotely positioned coin receptor of a coin hopper (not shown) for the vending machine. Liquid diverting coin chute 10 includes a housing, generally identified by the numeral 12 having a housing front portion 12*a* and a housing rear portion 12*b*. Housing 12 includes sidewalls 16 and 18; a front wall 22; a rear wall 24; a top wall 28; and a bottom wall 30. Housing front portion 12*a* is fastened to housing rear portion 12*b* by ultrasonic welding, glueing, or the like. Fasteners 34 pass through apertures 36 contained within front wall 22 and are received by apertures 38 in rear wall 24 to mount housing 12 to the vending machines. Apertures 34 are plugged after housing 12 is mounted.

Housing 12 includes an aperture 44 for receiving coins from the coin slot of the vending machine. Housing 12 further includes an aperture 48 disposed within bottom wall 30 for delivering coins to the coin receptor of the vending machine. A second aperture 50 is contained within bottom wall 30 of housing 12 for dispensing liquid from housing 12 to a remote location from the coin receptor via a drain 52, which is in fluid communication with aperture 50. Liquid diverting coin chute 10 functions to separate and divert incoming liquid flowing through aperture 44 into housing 12 from the coin receptor of a vending machine by preventing this liquid from entering aperture 48 while simultaneously conveying coins to aperture 48.

An important aspect of the present invention is the use of a screen, generally identified by the numeral 60 which is disposed within housing 12 of liquid diverting coin chute 10. Screen 60 is disposed within housing rear portion 12*b* and includes a front surface 62 which lies adjacent to front wall 22 of housing 12. Screen 60 further includes a back surface 64 which is disposed adjacent to rear wall 24 of housing 12. Screen 60 further includes apertures 68 through which fasteners 34 pass when mounting housing 12 to the vending machine.

Figure 5:
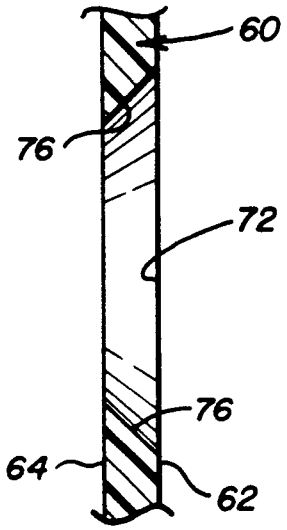
FIG. 5 is a cross-sectional view taken generally along section lines 5—5 of FIG. 4 illustrating an aperture of the present screen.
Figure 4:
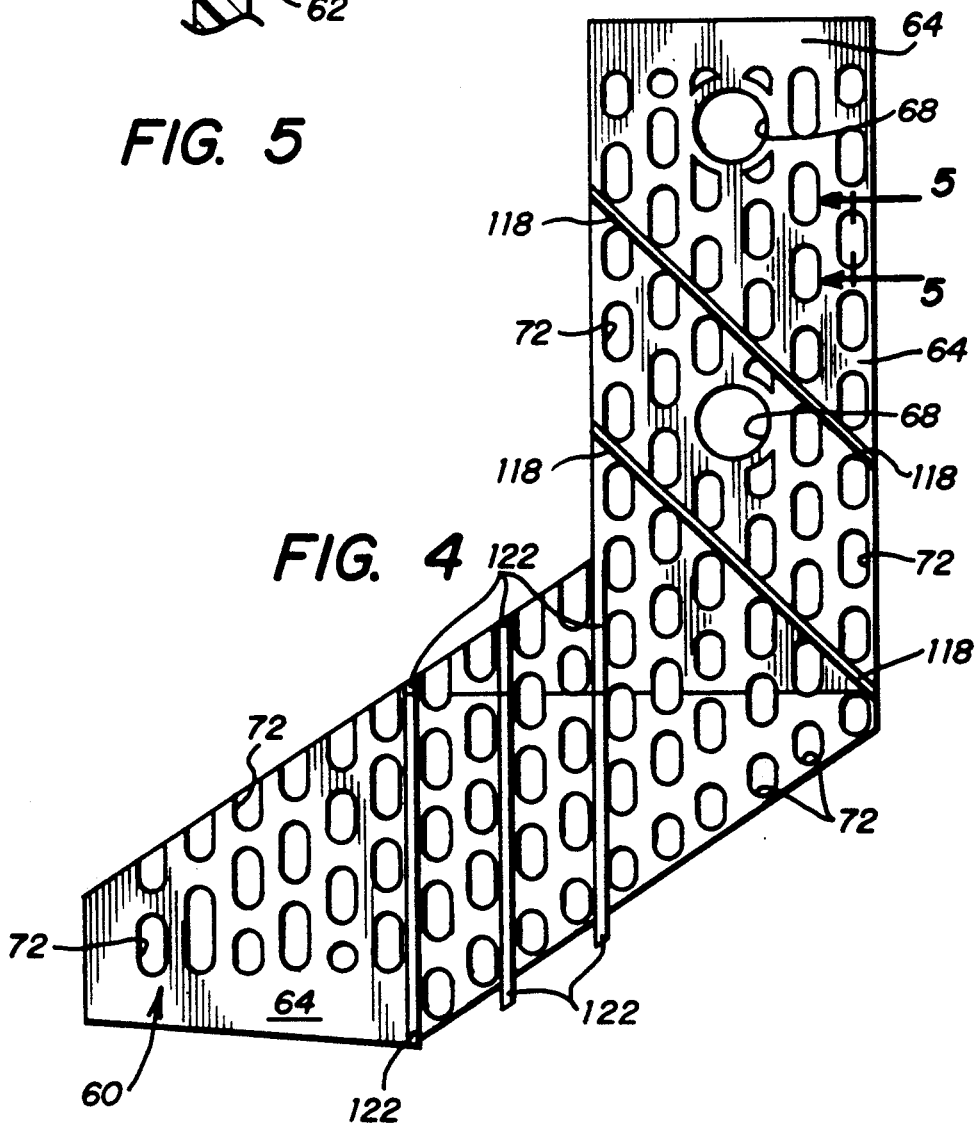
FIG. 4 is a rear elevational view of the screen of the present liquid diverting coin chute illustrated in FIG. 1.

Screen 60 functions to allow coins received by liquid diverting coin chute 10 through aperture 44 of housing 12 to pass over front surface 62 for deposit through aperture 48 to the coin receptor of the vending machine. Further, screen 60 diverts liquid from front surface 62 through a plurality of oval-shaped apertures 72 to the back surface 64 thereof (FIG. 4), such that liquid entering aperture 44 of housing 12 is diverted to aperture 50 for removal from housing 12. Apertures 72 are disposed throughout screen 60 such that the major axis of the oval-shaped apertures 72 lie generally parallel to sidewalls 16 and 18 of housing 12 and generally perpendicular to bottom wall 30 of housing 12. As more clearly illustrated in FIG. 5, apertures 72 include tapered sidewalls 76 extending from front surface 62 to back surface 64 of screen 60 to thereby draw liquid by capillary action through screen 60 toward rear wall 24 of housing 12 for diversion to aperture 50.

Screen 60 further includes a downwardly extending coin support surface 80 which is contacted by the edges of coins as coins pass through housing 12 from aperture 44 to aperture 48. Coin support surface 80 slants downwardly from side wall 16 to side wall 18 and functions to guide coins passing through housing 12. Coin support surface 80 further includes a plurality of apertures 84 which further function to divert liquid passing over front surface 62 of screen 60 to aperture 50 of housing 12. Coin support surface 80 is generally disposed perpendicularly to housing front wall 22. Through the use of apertures 84, liquid entering housing 12 is quickly diverted to aperture 50.

Referring to FIG. 2, housing rear portion **12*b* includes a plurality of ribs 104, within rear wall 24 which are generally perpendicularly disposed to bottom wall 30. Ribs 104 function to divert liquid from aperture 48 to bottom wall 30 and aperture 50 which liquid flows on rear wall 24. Additionally, housing side wall 16 includes a plurality of diagonally disposed ribs 106 for diverting liquid from aperture 48 to bottom wall 30 and aperture 50**.

Referring to FIG. 3, housing front portion **12*a* includes a plurality of ribs 110, generally perpendicularly disposed to bottom wall 30, and a plurality of ribs 112 diagonally disposed with respect to bottom wall 30. Ribs 110 and 112 function to divert liquid flowing on front wall 22 from aperture 48 to bottom wall 30 and aperture 50**.

Front wall 22 of housing 12 further includes ribs 114 which are disposed adjacent to front surface 62 of screen 60. Ribs 114 function to divert to side wall 16 of housing 12 any liquid which is splashed onto front wall 22 which has entered housing 12 through aperture 44 and to slow the flow of liquid over screen 60. In this manner, liquid is quickly diverted through apertures 72 which lie adjacent to side wall 16 of housing 12 which are located on the same side of housing 12 as aperture 50 is located.

In order to further divert liquid from screen 60 toward aperture 50 of housing 12, screen 60 further includes a plurality of diverting ribs 118 and 122. As more clearly shown in FIG. 4, diverting ribs 118 and 122 are disposed on back surface 64 of screen 60. Diverting ribs 118 function to channel liquid on back surface 64 toward aperture 50 of housing 12 and are disposed generally diagonal with respect to side walls 16 and 18 of housing 12. Diverting ribs 122 are generally disposed perpendicular to bottom wall 30 of housing 12 and divert liquid from back surface 64 of screen 60 toward bottom wall 30 of housing 12 to aperture 50.

It therefore can be seen that through the combined suction and diverting function performed by apertures 72 and 84, and diverting ribs 118 and 122, any liquid passing over front surface 62 of screen 60 is directed to bottom wall 30 of housing 12 to aperture 50. Liquid is thereby diverted from aperture 48 through which coins pass to the coin receptor of the vending machine utilizing the present liquid diverting coin chute 10.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A liquid diverting coin chute for conveying coins from a coin slot to a remotely positioned coin receptor, comprising:

a housing having side walls, front and rear walls, and top and bottom walls, said housing including a first aperture for receiving coins from the coin slot and a second aperture for delivering coins to the coin receptor and said housing bottom wall including an aperture for dispensing liquid from said housing:

a screen having front and back surfaces. disposed within said housing and extending from said housing first aperture to said housing second aperture and extending between said housing side walls for conveying coins along said front surface through said housing;

said screen including a plurality of apertures for the passage of liquid therethrough to said housing bottom wall aperture; and said screen further including a downwardly extending coin edge support surface interconnected to said screen and perpendicularly disposed to said screen front surface and extending to said housing front wall and between said housing side walls over which the edges of coins pass for directing coins between said housing side walls to said housing second aperture, said coin edge support surface including a plurality of apertures for the passage of liquid therethrough to said housing bottom wall aperture.

2. The coin chute of claim 1 wherein said screen apertures include tapered side walls extending from said screen front surface to said screen back surface.

3. The coin chute of claim 1 wherein said screen apertures are oval in shape.

4. The coin chute of claim 1 wherein said screen further includes a rib for diverting liquid from said screen to said housing bottom wall aperture.

5. The coin chute of claim 4 wherein said rib is disposed in said screen back surface.

6. The coin chute of claim 4 wherein said rib intersects ones of said plurality of screen apertures.

7. The coin chute of claim 1 wherein said screen front surface is disposed adjacent said housing front wall and said housing front wall includes means for diverting liquid to said housing bottom wall aperture.

8. The coin chute of claim 7 wherein said diverting means includes a downwardly directed rib extending from said housing front wall to adjacent said screen front surface.

9. The coin of chute of claim 1 wherein said screen further includes:

a plurality of ribs disposed in said screen back surface and adjacent to ones of said plurality of screen apertures for diverting liquid from said screen to said housing bottom wall aperture.

10. The coin chute of claim 9 wherein said plurality of ribs are disposed generally perpendicular to said housing bottom wall.

11. A liquid diverting coin chute for conveying coins from a coin slot to a remotely positioned coin receptor, comprising:

a housing having side walls, front and rear walls, and top and bottom walls, said housing including a first aperture for receiving coins from the coin slot and a second aperture for delivering coins to the coin receptor, and said housing bottom wall including an aperture for dispensing liquid from said housing;

a screen having front and back surfaces, said screen being disposed within said housing such that said screen front surface lies adjacent said housing front wall, said screen extending from said housing first aperture to said housing second aperture and extending between said housing side walls for conveying coins along said front surface through said housing;

said screen including a plurality of apertures for the passage of liquid therethrough to said housing bottom wall aperture and a downwardly extending coin support surface perpendicularly disposed to said housing front and rear walls and extending to said housing front wall and between said housing side walls over which the edges of coins pass for directing coins to said housing second aperture, said coin support surface including a plurality of apertures for the passage of liquid therethrough to said housing bottom wall aperture;

a plurality of ribs disposed in said screen back surface and adjacent to ones of said plurality of apertures for diverting liquid from said screen to said housing bottom wall aperture; and a plurality of ribs intersecting ones of said plurality of screen apertures disposed in said screen back surface for diverting liquid from said screen to said housing bottom wall aperture.

12. The coin chute of claim 11 wherein said screen apertures include tapered sidewalls extending from said screen front surface to said screen back surface and said screen apertures are oval in shape.

13. The coin chute of claim 11 wherein said housing front wall includes means for diverting liquid to said housing bottom wall aperture.

14. The coin chute of claim 13 wherein said diverting means includes a downwardly directed rib extending from said housing front wall to adjacent said screen front surface.

15. The coin chute of claim 12 wherein the major axes of said plurality of oval apertures lie generally perpendicularly to said housing bottom wall.

16. The coin chute of claim 11 wherein said housing front wall includes a plurality of ribs disposed generally perpendicularly to said housing bottom wall and a plurality of ribs disposed generally diagonally to said housing bottom wall for diverting liquid to said housing bottom wall.

17. The coin chute of claim 16 where said housing rear wall includes a plurality of ribs disposed generally perpendicularly to said housing bottom wall for diverting liquid to said housing bottom wall.

18. The coin chute of claim 17 wherein said housing side wall includes a plurality of ribs disposed generally diagonally to said housing bottom wall for diverting liquid to said housing bottom wall.

19. A liquid coin chute for conveying coins from a coin slot to a remotely positioned coin receptor, comprising:

a housing having side walls, front and rear walls, and top and bottom walls, said housing including a first aperture for receiving coins from the coin slot and a second aperture for delivering coins to the coin receptor and said housing bottom wall including an aperture for dispensing liquid form said housing;

a screen having front and back surfaces disposed within said housing and extending from said housing first aperture to said housing second aperture and extending between said housing side walls for conveying coins along said front surface through said housing;

said screen including a plurality of apertures for the passage of liquid therethrough to said housing bottom wall aperture and a rib intersecting ones of said plurality of screen apertures for diverting liquid from said screen to said housing bottom wall aperture; and said screen further including a downwardly extending coin support surface perpendicularly disposed to said housing front wall and extending between said housing side walls over which the edges of coins pass for directing coins to said housing second aperture, said coin support surface including a plurality of apertures for the passage of liquid therethrough to said housing bottom wall aperture.

20. The coin chute of claim 19 wherein said screen apertures include tapered side walls extending from said screen front surface to said screen back surface.

21. The coin chute of claim 19 wherein said screen apertures are oval in shape.

22. The coin chute of claim 19 wherein said rib is disposed in said screen back surface.

23. The coin chute of claim 19 wherein said screen front surface is disposed adjacent said housing front wall and said housing front wall includes means for diverting liquid to said housing bottom wall aperture.

24. The coin chute of claim 23 wherein said housing front wall diverting means includes a downwardly directed rib extending from said housing front wall to adjacent said screen front surface.

25. The coin chute of claim 19 wherein said screen further includes:

a plurality of ribs disposed in said screen back surface and adjacent to ones of said plurality of screen apertures for diverting liquid from said screen to said housing bottom wall aperture.

26. The coin chute of claim 25 wherein said plurality of ribs are disposed generally perpendicular to said housing bottom wall.

* * * * *